US008109494B1

(12) United States Patent
Warth

(10) Patent No.: US 8,109,494 B1
(45) Date of Patent: Feb. 7, 2012

(54) WORKHOLDING APPARATUS HAVING A MOVABLE JAW MEMBER

(75) Inventor: Jeffrey M. Warth, Mars, PA (US)

(73) Assignee: Chick Workholding Solutions, Inc., Warrendale, PA (US)

( * ) Notice: Subject to any disclaimer, the term of this patent is extended or adjusted under 35 U.S.C. 154(b) by 962 days.

(21) Appl. No.: 11/897,157

(22) Filed: Aug. 29, 2007

Related U.S. Application Data

(60) Provisional application No. 60/841,824, filed on Sep. 1, 2006.

(51) Int. Cl.
*B25B 1/20* (2006.01)

(52) U.S. Cl. ..... 269/43; 269/45; 269/136

(58) Field of Classification Search ..... 269/43, 269/45, 136, 95, 264, 271, 278; 248/229.12, 248/229.22, 228.3, 230.3, 231.41; 81/44, 81/13, 92, 111, 126, 128
See application file for complete search history.

(56) References Cited

U.S. PATENT DOCUMENTS

| | | | | |
|---|---|---|---|---|
| 287,271 | A * | 10/1883 | Gladwin | 269/244 |
| 307,439 | A | 11/1884 | Corbett | |
| 463,332 | A | 11/1891 | Giles | |
| 600,370 | A * | 3/1898 | Kohler | 29/258 |
| 731,871 | A | 6/1903 | Echols | |
| 1,262,621 | A * | 4/1918 | Beacham | 81/392 |
| 1,329,602 | A * | 2/1920 | Hultberg | 269/85 |
| 1,365,784 | A * | 1/1921 | Husson | 81/98 |
| 1,385,088 | A | 7/1921 | Mellor | |
| 1,393,083 | A | 10/1921 | Campbell | |
| 1,495,772 | A | 5/1924 | Brown | |
| 1,550,751 | A | 8/1925 | Sinkler | |
| 1,811,299 | A | 6/1931 | Brockhaus, Jr. | |
| 1,850,178 | A | 3/1932 | McChesney | |
| 2,061,718 | A | 11/1936 | Stahl | |
| 2,227,443 | A | 1/1941 | Denner | |
| 2,251,016 | A | 7/1941 | Gallimore | |
| 2,274,428 | A | 2/1942 | Odin | |
| 2,339,986 | A | 1/1944 | Engert | |
| 2,369,425 | A | 2/1945 | Becker | |
| 2,406,043 | A | 8/1946 | Sorensen | |
| 2,487,742 | A | 11/1949 | Sutter | |
| 2,499,124 | A | 2/1950 | Zipp et al. | |
| 2,535,450 | A | 12/1950 | O'Malley et al. | |
| 2,560,413 | A | 7/1951 | Carlson | |

(Continued)

FOREIGN PATENT DOCUMENTS

| | | |
|---|---|---|
| CH | 480 912 | 12/1969 |

(Continued)

*Primary Examiner* — George Nguyen
(74) *Attorney, Agent, or Firm* — K&L Gates LLP

(57) ABSTRACT

A device for holding a workpiece, the device comprising a base, a first jaw member, a movable jaw member, and features which allow the movable jaw member to be moved in large increments relative to the first jaw member in addition to features which allow the movable jaw member to be moved in smaller increments. The device can include a drive member operably engaged with the base and the movable jaw member such that the operation of the drive member can move the movable jaw member in small increments. The movable jaw member can include a connection member, or claw, which can operatively engage the movable jaw member with the drive member. The connection member can be moved between first and second positions to disengage the movable jaw member from the drive member such that the movable jaw member can be slid relative to the first jaw member in large increments.

24 Claims, 15 Drawing Sheets

U.S. PATENT DOCUMENTS 2,564,138 A 8/1951 Walker
2,570,857 A * 10/1951 Purpura ..... 269/138
2,630,702 A 3/1953 Pizzani
2,661,783 A 12/1953 Caston
2,699,708 A 1/1955 Fotsch
2,707,419 A 5/1955 Schron
2,711,904 A 5/1955 Gartner et al.
2,845,038 A 7/1956 Crawford
2,764,047 A 9/1956 Allbritton
2,770,990 A * 11/1956 Rix ..... 269/136
2,868,339 A 1/1959 Lazarowicz
2,880,638 A 4/1959 Muggille at al.
2,885,910 A 5/1959 Waller
2,889,396 A 6/1959 Bode
2,952,169 A 9/1960 Johnson
2,976,844 A 3/1961 Goldring
3,020,996 A 2/1962 Webb
3,162,064 A 12/1964 Musy
3,186,260 A 6/1965 Dugas
3,203,082 A 8/1965 Robbins
3,204,490 A 9/1965 Jones et al.
3,397,860 A 8/1968 Kuban
3,403,901 A 10/1968 Serivadio
3,496,832 A 2/1970 Celinder et al.
3,514,092 A 5/1970 Lassy
3,565,417 A 2/1971 Degle
3,612,384 A 10/1971 Lloyd et al.
3,814,448 A 6/1974 Buck
3,835,649 A 9/1974 Le Testu
3,861,664 A 1/1975 Durkee
3,967,816 A 7/1976 Ramsperger et al.
3,968,415 A 7/1976 Hafla et al.
4,017,267 A 4/1977 Hawley
4,019,726 A 4/1977 Turner
4,043,547 A 8/1977 Glomb et al.
4,068,834 A * 1/1978 Mortoly ..... 269/264
4,089,613 A 5/1978 Babbitt, Jr.
4,098,500 A 7/1978 Lenz
4,121,817 A 10/1978 Pavlovsky
4,125,251 A 11/1978 Jamieson, Jr.
4,165,869 A 8/1979 Williams
4,170,345 A 10/1979 Townsend
4,184,691 A 1/1980 Esser et al.
4,205,833 A 6/1980 Lenz
4,221,369 A 9/1980 Takasugi
4,240,621 A * 12/1980 Daddato ..... 269/264
4,252,304 A 2/1981 Pettican
4,295,641 A * 10/1981 Boucher ..... 269/136
4,319,516 A 3/1982 Rohm
4,324,161 A 4/1982 Klancnik et al.
4,353,271 A 10/1982 Pieczulewski
4,413,818 A 11/1983 Lenz
4,496,165 A 1/1985 Schrekeis et al.
4,504,046 A 3/1985 Yonezawa et al.
4,524,655 A 6/1985 Waldron et al.
4,529,183 A 7/1985 Krason et al.
4,545,470 A 10/1985 Grimm
4,569,509 A 2/1986 Good
4,571,131 A 2/1986 Date
4,585,217 A 4/1986 Erickson
4,619,446 A 10/1986 Yang
4,643,411 A 2/1987 Izumi
4,644,825 A 2/1987 Yamazaki
4,664,394 A 5/1987 Theissig et al.
4,669,161 A 6/1987 Sekelsky, Jr.
4,684,115 A 8/1987 Krause
4,685,663 A 8/1987 Jorgensen
4,711,437 A 12/1987 Longenecker et al.
4,738,438 A 4/1988 Horie et al.
4,773,636 A 9/1988 Takahashi
4,779,857 A 10/1988 Mound
4,799,657 A 1/1989 Miller
4,813,310 A 3/1989 Moynihan
4,834,358 A 5/1989 Okolischan et al.
4,850,099 A 7/1989 Scollard
4,881,727 A 11/1989 Nemirovsky
4,884,474 A 12/1989 Kawata
4,898,371 A 2/1990 Mills et al.
4,921,378 A 5/1990 Kytola
4,928,937 A 5/1990 Bernstein
4,934,674 A 6/1990 Bernstein
4,936,559 A 6/1990 Diaz Torga
4,946,178 A 8/1990 Korson et al.
4,966,350 A 10/1990 Chick
4,968,012 A 11/1990 Haddad et al.
4,971,301 A 11/1990 Yang
4,974,308 A 12/1990 Nimberger
4,986,704 A 1/1991 Narushima et al.
4,991,463 A 2/1991 Kawata
5,013,017 A 5/1991 Swann
5,015,003 A 5/1991 Ramunas
5,022,636 A * 6/1991 Swann ..... 269/43
5,024,427 A 6/1991 Swann
5,033,724 A 7/1991 James
5,064,321 A 11/1991 Barnes
5,090,529 A 2/1992 Fahy et al.
5,094,436 A * 3/1992 Stephan, III ..... 269/153
5,098,073 A 3/1992 Lenz
5,114,126 A * 5/1992 Yasue ..... 269/32
5,129,637 A 7/1992 Ito et al.
5,136,896 A 8/1992 Burka
5,160,124 A 11/1992 Yamada et al.
5,161,788 A 11/1992 Guzzoni
5,163,662 A 11/1992 Bernstein
5,193,792 A 3/1993 DiMarco
5,242,159 A 9/1993 Bernstein
5,251,887 A * 10/1993 Arnold et al. ..... 269/221
5,306,136 A 4/1994 Oomori et al.
5,322,305 A 6/1994 Cross et al.
5,339,504 A 8/1994 Thumm et al.
5,351,943 A 10/1994 Milz
5,374,040 A 12/1994 Lin
5,374,145 A 12/1994 Mairesse et al.
5,441,284 A 8/1995 Mueller et al.
5,442,844 A 8/1995 Swann
5,458,321 A 10/1995 Durfee, Jr.
5,501,123 A 3/1996 Swann et al.
5,526,715 A 6/1996 Swann et al.
5,531,428 A * 7/1996 Dembicks et al. ..... 269/172
5,535,995 A 7/1996 Swann et al.
5,549,427 A 8/1996 Hiestand
5,562,277 A 10/1996 Swann et al.
5,623,754 A 4/1997 Swann et al.
5,623,757 A 4/1997 Durfee, Jr.
5,634,253 A 6/1997 Swann et al.
5,649,694 A 7/1997 Buck
5,713,118 A 2/1998 Swann et al.
5,720,476 A 2/1998 Swann et al.
5,735,514 A 4/1998 Moore et al.
5,762,326 A 6/1998 Swann
5,806,841 A 9/1998 Hebener
5,921,534 A 7/1999 Swann et al.
5,971,380 A 10/1999 Hebener
6,032,940 A * 3/2000 Wolfe ..... 269/279
6,164,635 A * 12/2000 Chase et al. ..... 269/244
6,170,814 B1 1/2001 Swann et al.
6,206,354 B1 * 3/2001 Lin ..... 269/43
6,240,807 B1 6/2001 Hebener
6,250,620 B1 * 6/2001 Durfee, Jr. ..... 269/43
6,598,867 B2 * 7/2003 Martinez ..... 269/43
6,669,254 B2 * 12/2003 Thom et al. ..... 294/19.1
6,761,349 B2 * 7/2004 McCraw ..... 269/212
7,290,761 B2 * 11/2007 Siegel ..... 269/266

FOREIGN PATENT DOCUMENTS

DE 1904673 11/1964
DE 1918387 4/1969
DE 1652956 6/1969
DE 1750374 1/1971
DE 2 407 554 9/1974
DE 27 53 507 6/1979
DE 39 29512 A1 3/1991
DE 4339439 3/1995
EP 0 343 329 A 11/1989
EP 0 440 585 8/1991
EP 0 450 538 A2 9/1991
EP 0526432 A1 7/1992

| | | | |
|---|---|---|---|
| FR | 2 307 602 | | 3/1976 |
| FR | 2 576 160 | | 9/1986 |
| GB | 562447 | | 3/1944 |
| GB | 2123722 | | 2/1964 |
| GB | 1266942 | | 3/1972 |
| GB | 2073063 | A | 10/1981 |
| GB | 2075874 | A | 11/1981 |
| GB | 2 103 522 | | 7/1982 |
| GB | 2177647 | A * | 1/1987 |
| JP | 61-24446 | | 10/1986 |
| SU | 1397-250 | | 5/1988 |
| WO | WO 89/08518 | | 9/1989 |
| WO | WO 89/11950 | | 12/1989 |
| WO | WO 97/08594 | | 3/1997 |
| WO | WO 97/47429 | | 12/1997 |

* cited by examiner

WORKHOLDING APPARATUS HAVING A MOVABLE JAW MEMBER

CROSS-REFERENCE TO RELATED APPLICATION

This application claims the benefit under 35 U.S.C. §119 (e) of U.S. Provisional Patent Application Ser. No. 60/841,824, entitled WORKHOLDING APPARATUS, filed on Sep. 1, 2006, the entire disclosure of which is hereby incorporated by reference herein.

BACKGROUND

1. Field of the Invention

The present invention generally relates to devices for holding workpieces and, more particularly, to devices used in connection with high precision machining (CNC, etc.) operations.

2. Description of the Related Art

High precision machining operations often utilize workholding devices, such as vises, for example, for holding a workpiece in position while the workpiece is cut, milled, and/or polished. As is well known in the art, financially successful machining operations utilize vises which are quickly and easily adaptable to hold a workpiece in different positions and orientations during the machining operation. These vises typically include a rigid base, a fixed jaw member mounted to the base, and a movable jaw member. In use, the workpiece is often positioned between the fixed jaw member and the movable jaw member, wherein the movable jaw member is then positioned against the workpiece. In various embodiments, the movable jaw member can be moved via the interaction of a threaded rod with the base and the movable jaw. Often, the threaded rod must be rotated a significant amount of times before the movable jaw member is positioned against the workpiece. What is needed is an improvement over the foregoing.

SUMMARY

The present invention includes a device for holding a workpiece, the device comprising, in one form, a base, a first jaw member, a movable jaw member, and features which allow the movable jaw member to be moved in large increments relative to the first jaw member in addition to features which allow the movable jaw member to be moved in smaller increments. In various embodiments, the device can include a drive member operably engaged with the base and the movable jaw member such that the operation of the drive member can move the movable jaw member in small increments. In at least one embodiment, the movable jaw member can include at least one connection member, or claw, which can operatively engage the movable jaw member with the drive member. In such embodiments, the connection member can be moved between first and second positions to disengage the movable jaw member from the drive member such that the movable jaw member can be slid relative to the drive member, and the first jaw member, in large increments. In various embodiments, the connection member, or claw, can be rotated or pivoted between its first and second positions. As a result of the above, the movable jaw member can be accurately and precisely positioned relative to the workpiece and/or the first jaw member.

BRIEF DESCRIPTION OF THE DRAWINGS

The above-mentioned and other features of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate preferred embodiments of the invention, in one form, and such exemplifications are not to be construed as limiting the scope of the invention in any manner.

DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

Figure 1:
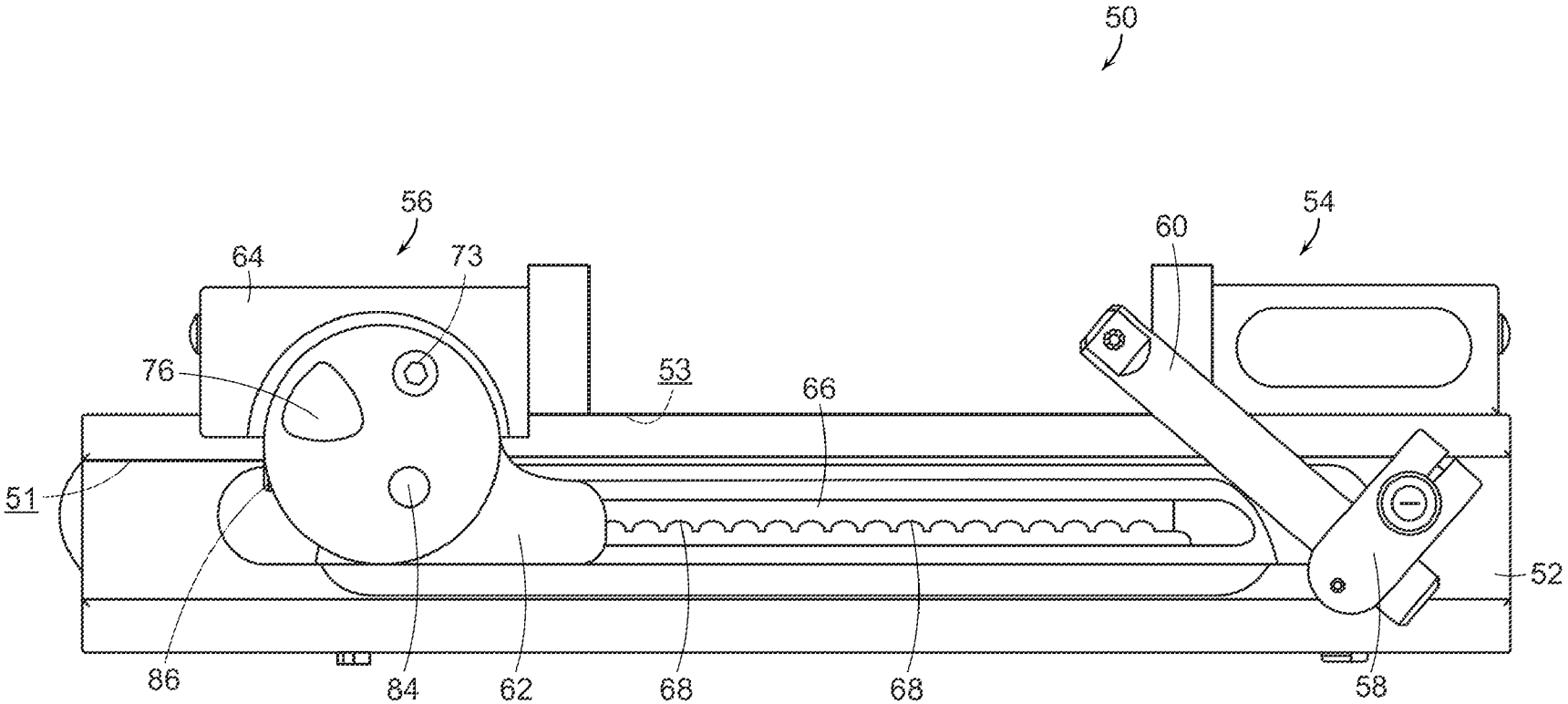
FIG. 1 is an elevational view of an exemplary workholding device in accordance with an embodiment of the present invention.

In various embodiments, referring to FIG. 1, workholding device 50 can include base 52, first jaw member 54, and second jaw member 56. In use, a workpiece can be positioned on surface 53 of base 52 intermediate first jaw member 54 and second jaw member 56 wherein at least one of jaw members 54 and 56 can be positioned or moved against the workpiece to apply a clamping force thereto. In the illustrated embodiment, first jaw member 54 can be fixedly mounted to base 52 and, as described in greater detail below, second jaw member 56 can be movable relative to base 52. In various alternative embodiments, although not illustrated, a workholding device can include two or move movable jaw members. A workholding device having two movable jaw members and a fixed jaw member is described and illustrated in U.S. Pat. No. 5,022,636, entitled WORKHOLDING APPARATUS, which issued on Jun. 11, 1991, the content of which is hereby incorporated by reference herein. In either event, in at least one embodiment, device 50 can further include work stop 58 which can be configured to control at least the transverse position of the workpiece within device 50. More particularly, in at least one embodiment, work stop 58 can include a post which is adjustably threaded into base 52 and, in addition, a friction clamp configured to allow extension rod 60 to be rotated into any suitable orientation or extended into any suitable position. In various embodiments, work stop 58 can further include a threaded rod or set screw extending from extension rod 60 which can be adjusted to abut the workpiece and hold the workpiece in position.

As outlined above, second jaw member 56 can be moved relative to base 52. In various embodiments, workholding device 50 can include features which can allow second jaw member 56 to be moved in large increments relative to base 52 and first jaw member 54 and, in addition, features which can allow jaw member 56 to be moved in small increments. In at least one embodiment, referring to FIGS. 5 and 6, second jaw member 56 can include body portion 64 and at least one connection member, or claw, 62 movably mounted to body portion 64. In such embodiments, a connection member 62 can be selectively engaged with base 52, for example, to retain jaw member 56 to base 52. More particularly, connection member 62 can be positioned in a first position in which connection member 62 is engaged with base 52 and, as a result, second jaw member 56 can be fixed, or substantially fixed, relative to base 52. In at least one embodiment, connection member 62 can be selectively moved into a second position in which it is not engaged with base 52 wherein, as a result, second jaw member 56 can be moved relative to base 52. Stated another way, once connection member 62 is moved into a position in which it is not engaged with racks 66, as described below, second jaw member 56 can be slid relative to base 52 along displacement axis 55 (FIG. 3), for example, in large increments and placed against a workpiece positioned intermediate jaw members 54 and 56 as outlined above. In various alternative embodiments, although not illustrated, second jaw member 56 can be moved along a curved and/or curvilinear path.

Figure 7:
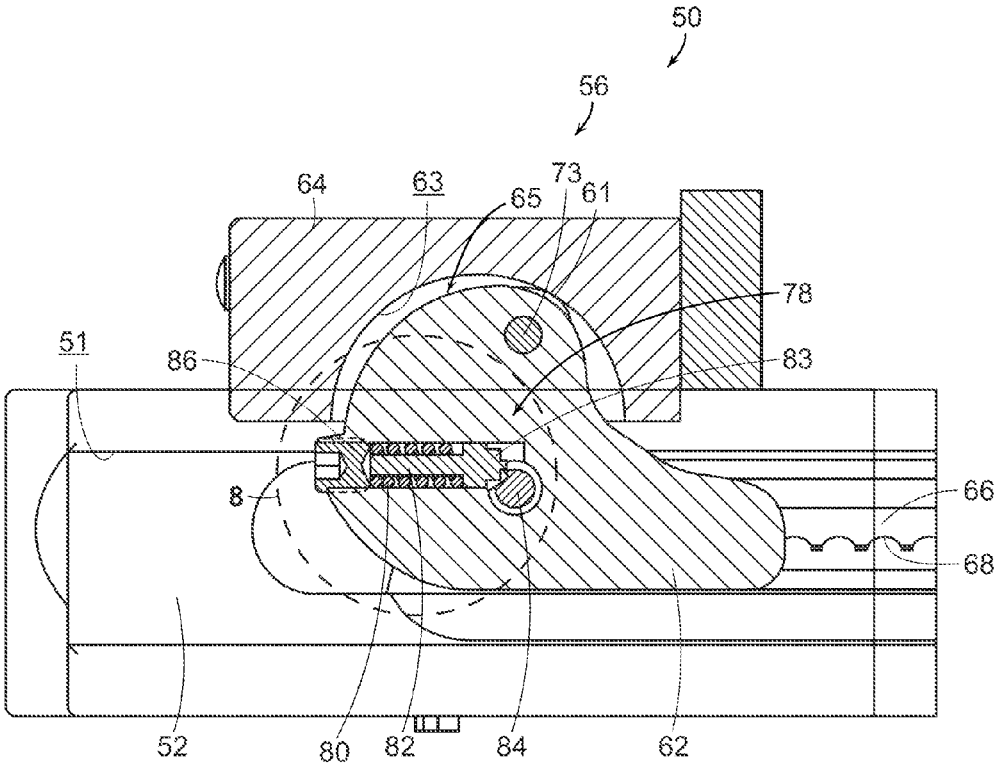
FIG. 7 is a cross-sectional view of the workholding device of FIG. 1 taken along line 7-7 in FIG. 3.
Figure 8:
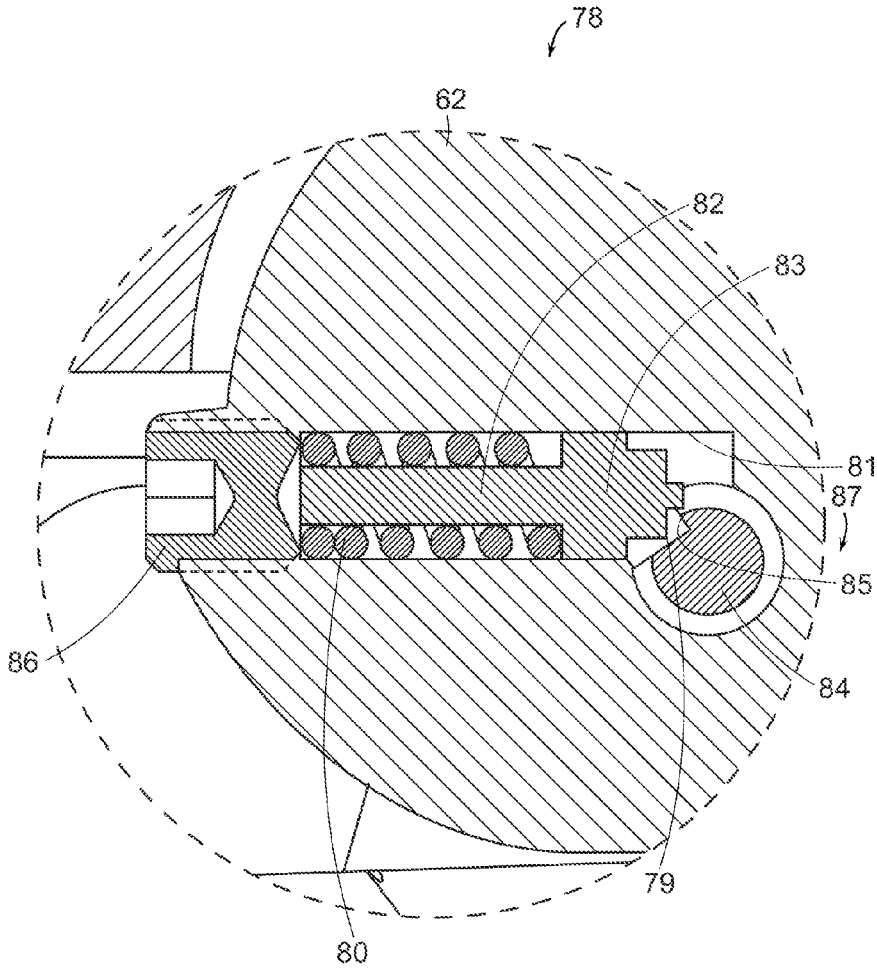
FIG. 8 is a detail view of a portion of the movable jaw member of FIG. 7 illustrating a spring assembly configured to bias the connection member into an engaged position.
Figure 9:
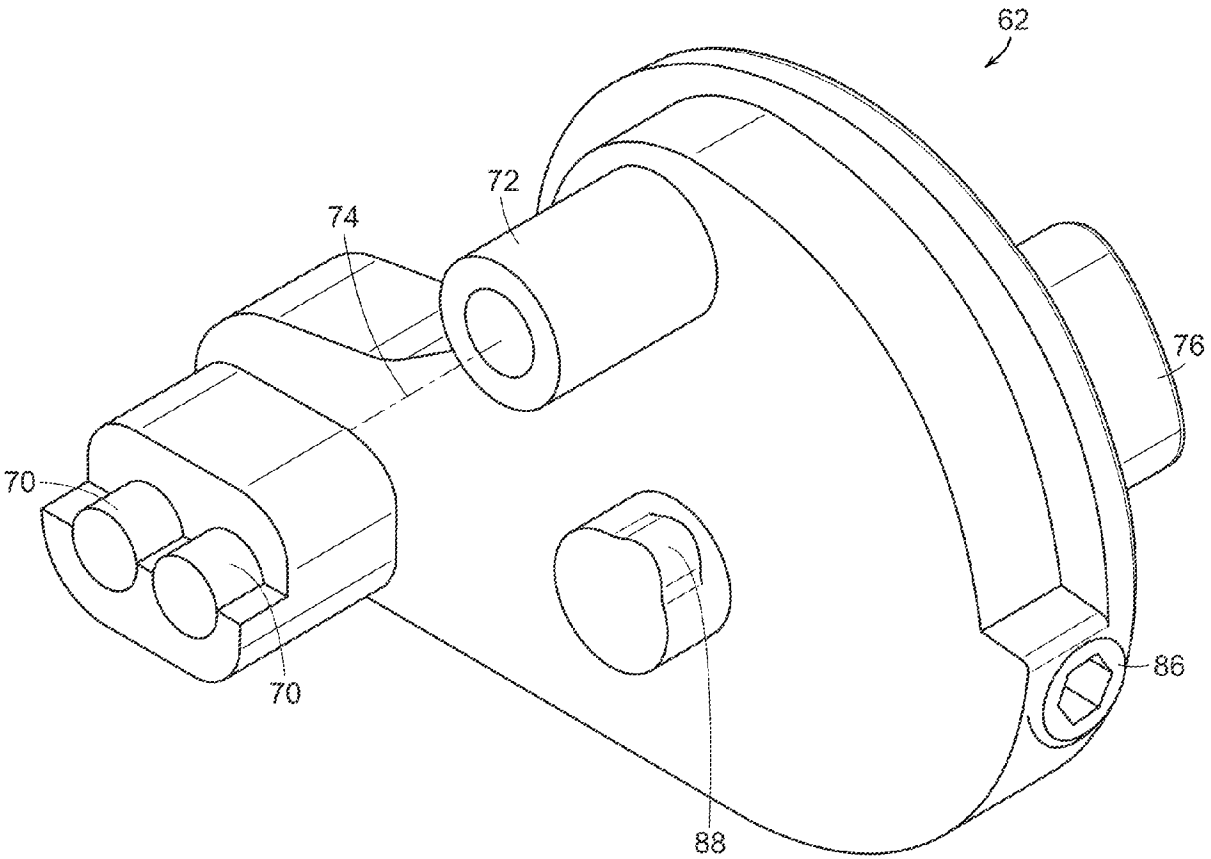
FIG. 9 is a perspective view of the connection member of FIG. 5.

In various embodiments, base 52 can include at least one rack 66, wherein each rack 66 can include notches, or recesses, 68. Recesses 68 can be configured to receive at least a portion of connection members 62 and secure second jaw member 56 relative to base 52 as outlined above. In at least one embodiment, referring to FIGS. 5, 6 and 9, each connection member 62 can include at least one projection 70 extending therefrom which can be configured to be received within recesses 68. In various embodiments, referring to FIG. 7, each recess, or notch, 68 can include an arcuate or circular profile which can be configured to receive a projection 70 having a corresponding arcuate or circular profile, for example. In at least one embodiment, although not illustrated, recesses 68 can include a linear groove, or a groove having any other suitable profile, which can be configured to receive a projection having a corresponding or other suitable profile, similar to the above. In various embodiments, such recesses can be oriented in a vertical direction, for example, or any other suitable direction. In at least one embodiment, the recesses can be oriented at an approximately 20 degree angle from the vertical direction.

Figure 10:
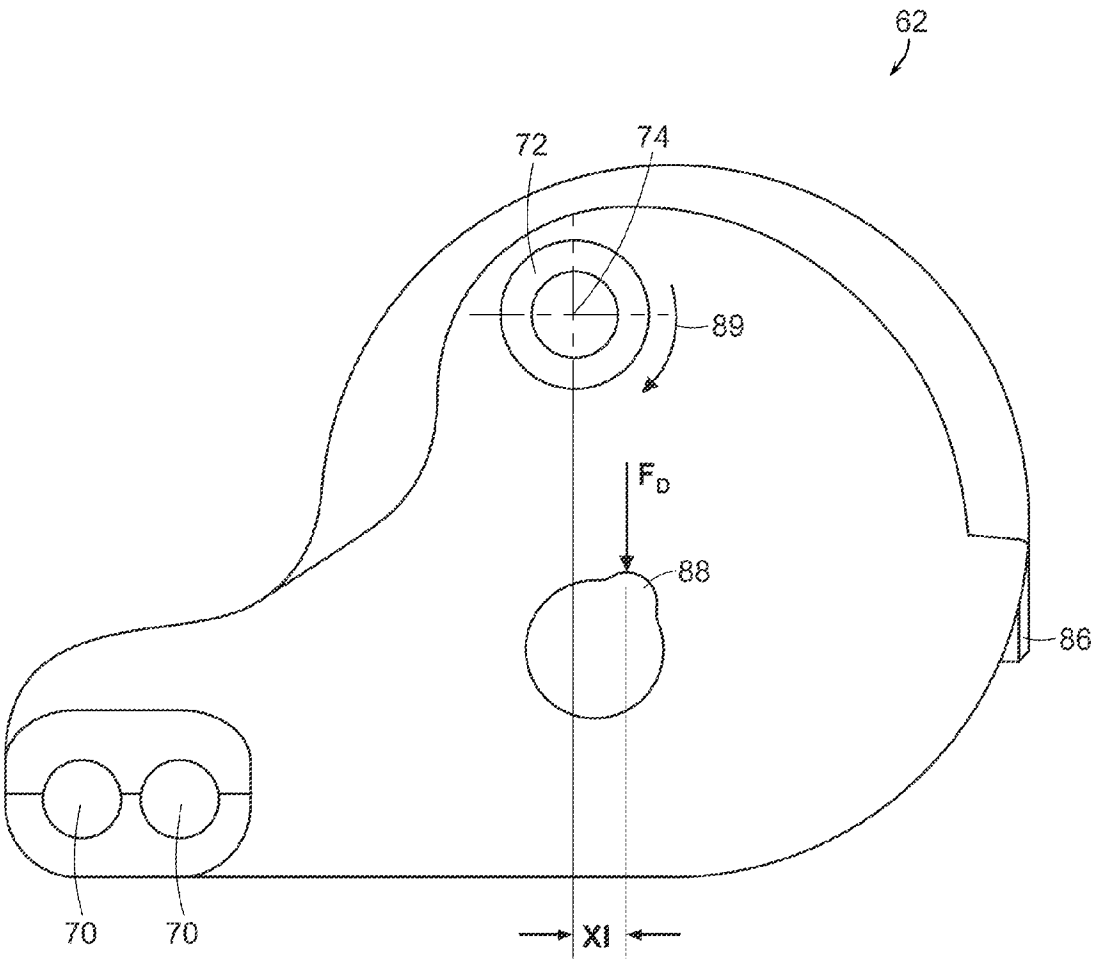
FIG. 10 is an elevational view of the connection member of FIG. 5.

In order to remove projections 70 from recesses 68, and thereby disengage second jaw member 56 from base 52, connection members 62 can be moved such that projections 70 are displaced away from recesses 68. In at least one embodiment, connection members 62 can be rotatably mounted to body portion 64. More particularly, referring to FIGS. 7, 9 and 10, each connection member 62 can include a pivot 72 which can be pivotably mounted to body portion 64 by a pivot pin 73, for example, wherein the cooperation of pivot 72 and pin 73 can define pivot axis 74 about which connection member 62 can be rotated. In various embodiments, axis 74 and axis 55 can extend in any suitable direction relative to each other. In the illustrated embodiment, axis 74 can be perpendicular, or at least substantially perpendicular, to axis 55 such that connection members 62 can be pivoted upwardly and/or downwardly relative to base 52 as described in greater detail below. In other various embodiments, although not illustrated, axes 74 and 55 can be transverse, skew, or parallel to each other. In such embodiments, connection members 62 can be pivoted outwardly away from racks 66, for example. In at least one embodiment, at least one of axes 74 can be oriented at an approximately 20 degree angle with respect to the horizontal plane. In such embodiments, a connection member 62 can be configured to rotate in a plane which is neither parallel nor perpendicular to the horizontal or vertical planes.

Figure 2:
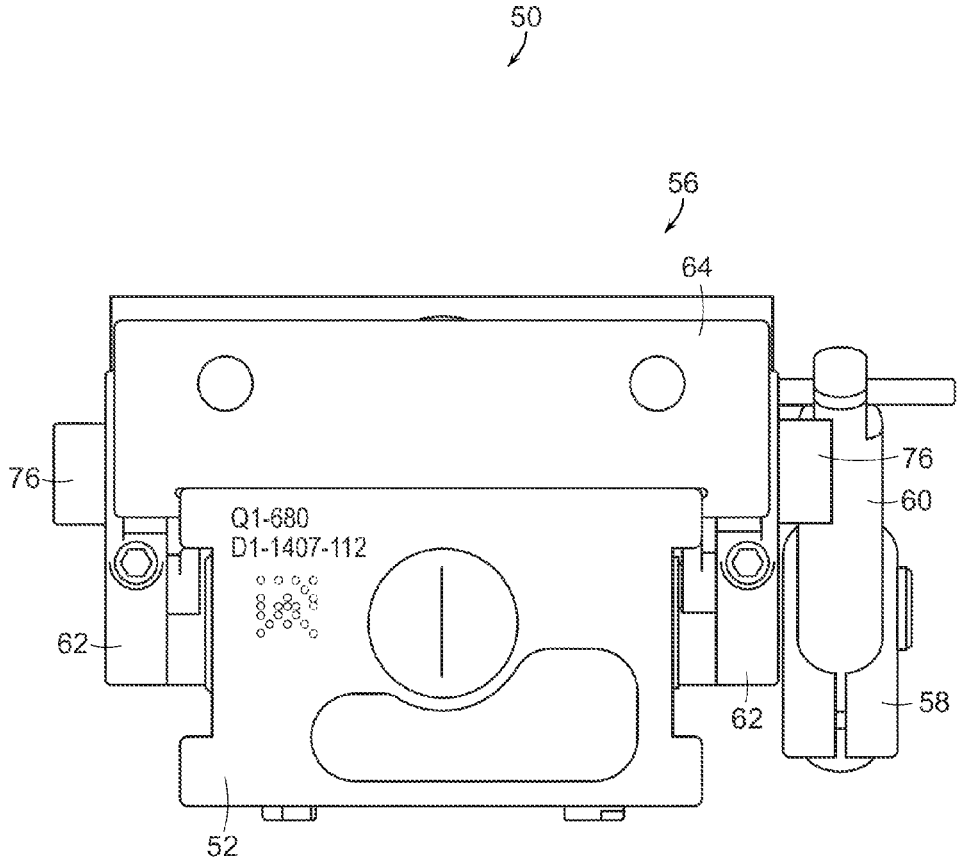
FIG. 2 is an end view of the workholding device of FIG. 1.
Figure 3:
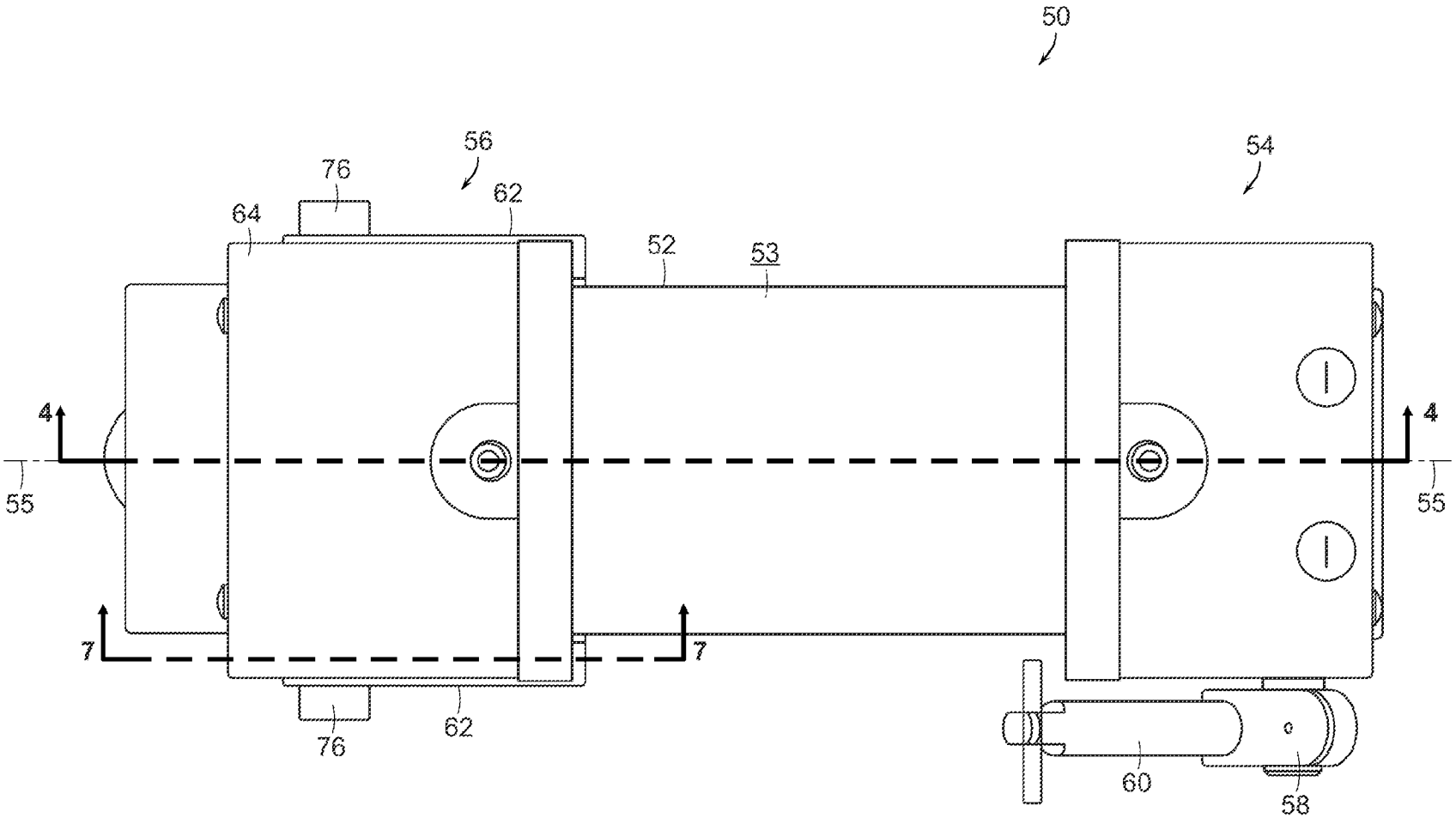
FIG. 3 is a top view of the workholding device of FIG. 1.
Figures 5, 6:
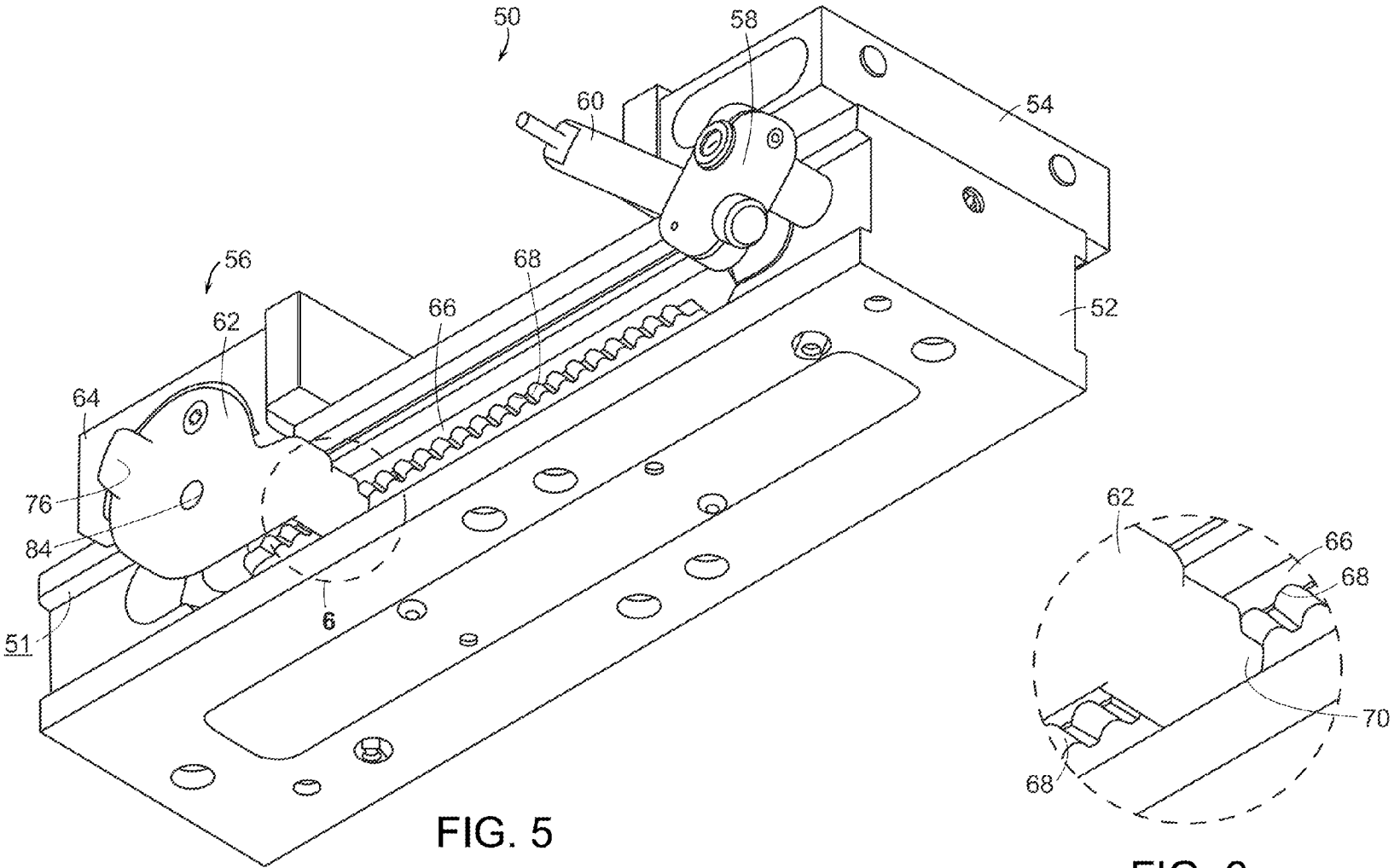
FIG. 5 is a perspective view of the workholding device of FIG. 1 illustrating a movable jaw member including a connection member engaged with an adjustment rack assembly.
FIG. 6 is a detail view of the movable jaw member of the workholding device of FIG. 1 illustrating a portion of the connection member engaged with the rack assembly.

In various embodiments, referring to FIGS. 2, 3, and 5, connection members 62 can further include projections, or handles, 76 extending therefrom. In at least one embodiment, handles 76 can be configured such that they can be grasped by an operator to rotate connection members 62 between a first position in which connection members 62 are engaged with racks 66 and a second position in which connection members 62 are disengaged from racks 66. In various embodiments, workholding device 50 can further include a biasing member such as a spring, for example, which can bias a connection member 62 into engagement with a rack 66. In at least one such embodiment, referring to FIGS. 7-10, connection member 62 can include spring assembly 78 comprising spring 80, drive pin 82, and cam pin 84. In various embodiments, spring 80 can be positioned within cavity 81 intermediate fastener 86 and head 83 of drive pin 82 wherein fastener 86 can be threaded into, or otherwise suitably retained in, cavity 81. In various embodiments, spring 80 can be configured to bias drive pin 82 against cam pin 84 and apply a biasing force to cam pin 84. As described in greater detail below, this biasing force can rotate connection member 62 about axis 74, for example, such that projections 70 are biased into engagement with recesses 68.

Figure 11:
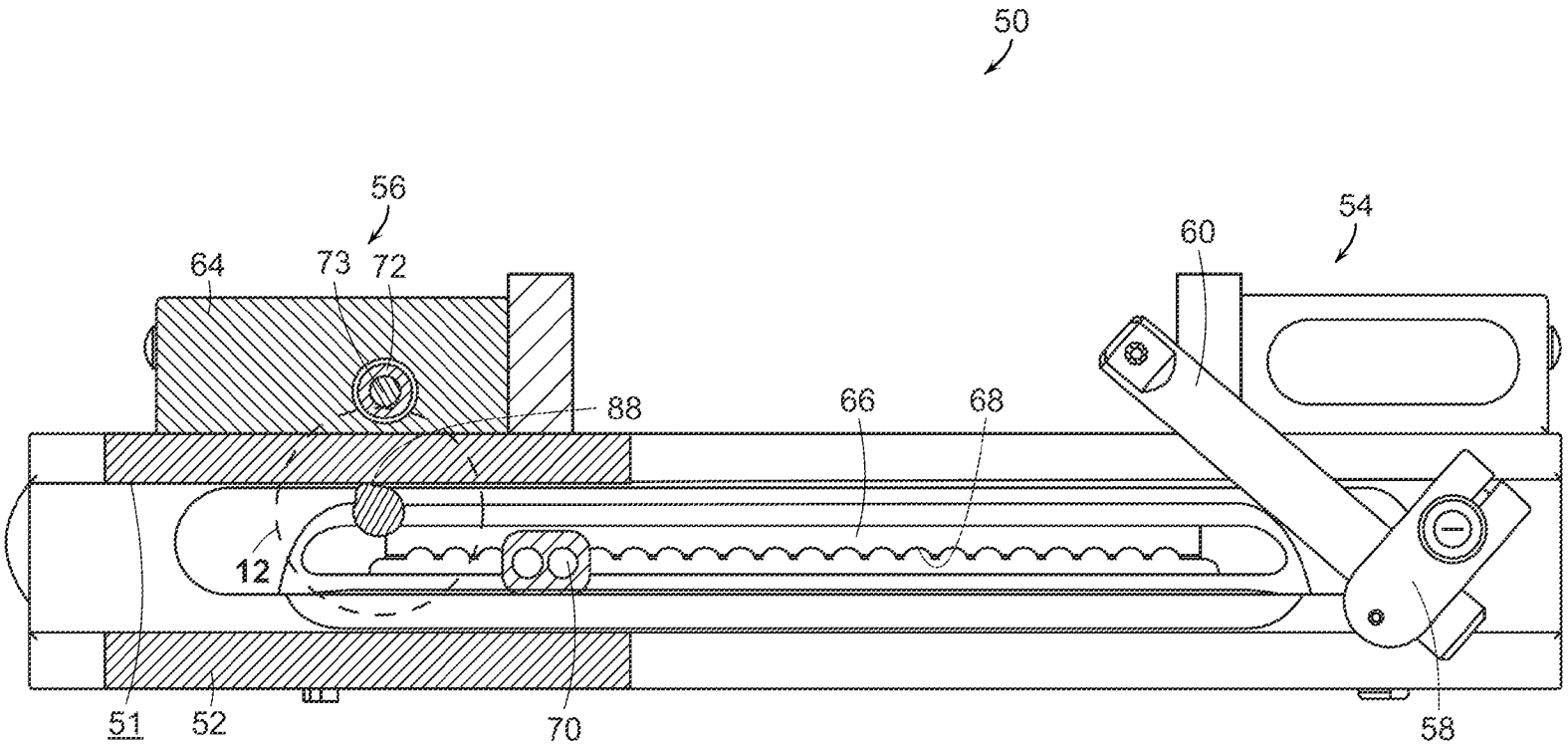
FIG. 11 is a cross-sectional view of the workholding device of FIG. 1 taken along a line to illustrate a cam extending from the spring assembly of FIG. 8 configured to cooperate with a base of the workholding device and bias the connection member into the engaged position.
Figure 12:
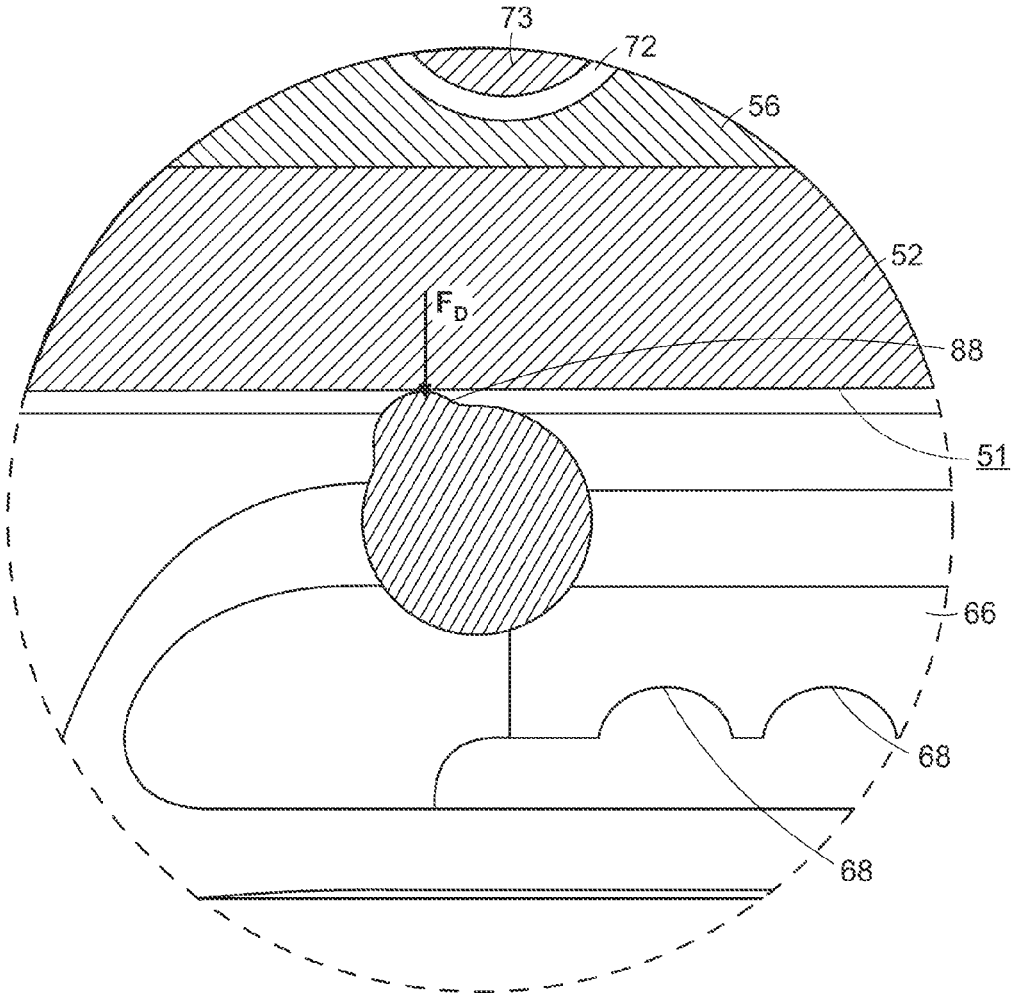
FIG. 12 is a detail view of the cam of FIG. 11.
Figure 13:
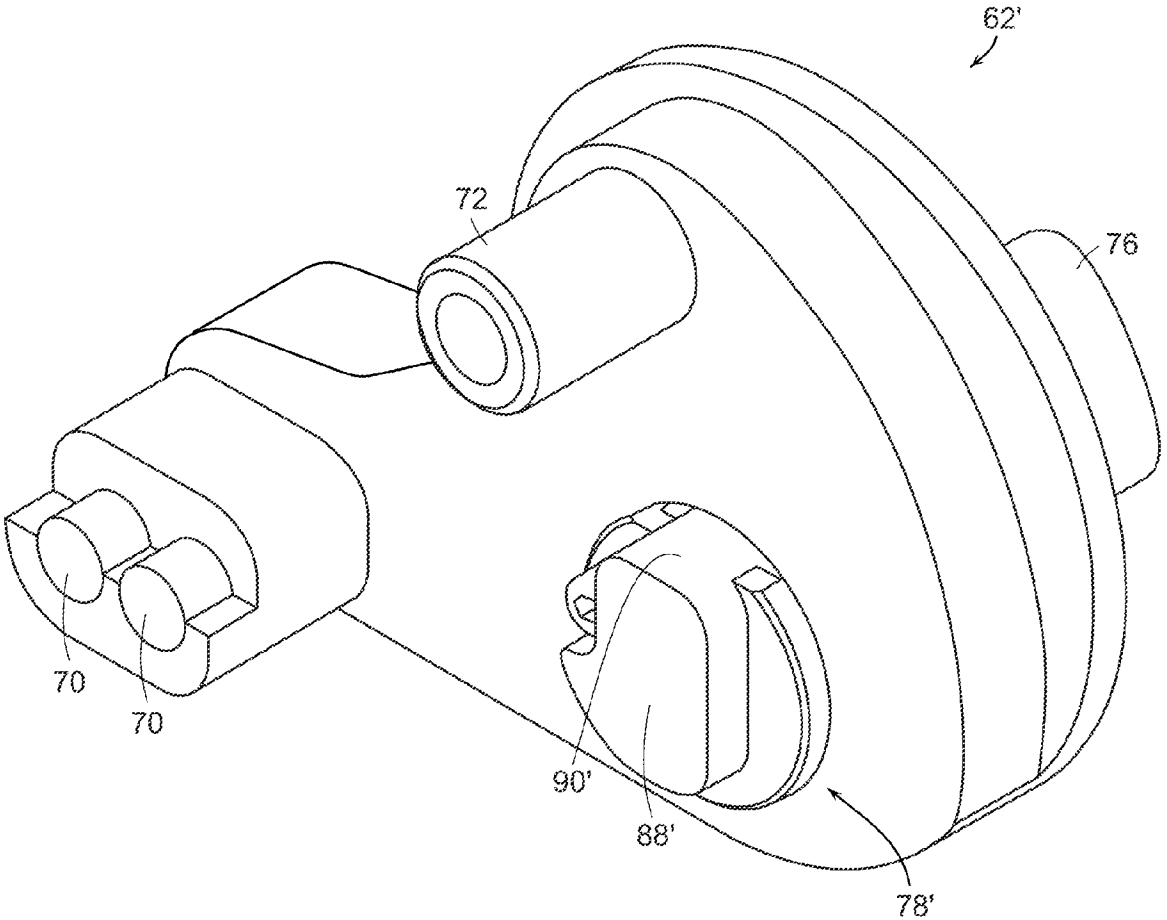
FIG. 13 is a perspective view of a connection member of a movable jaw member in accordance with an alternative embodiment of the present invention.
Figure 14:
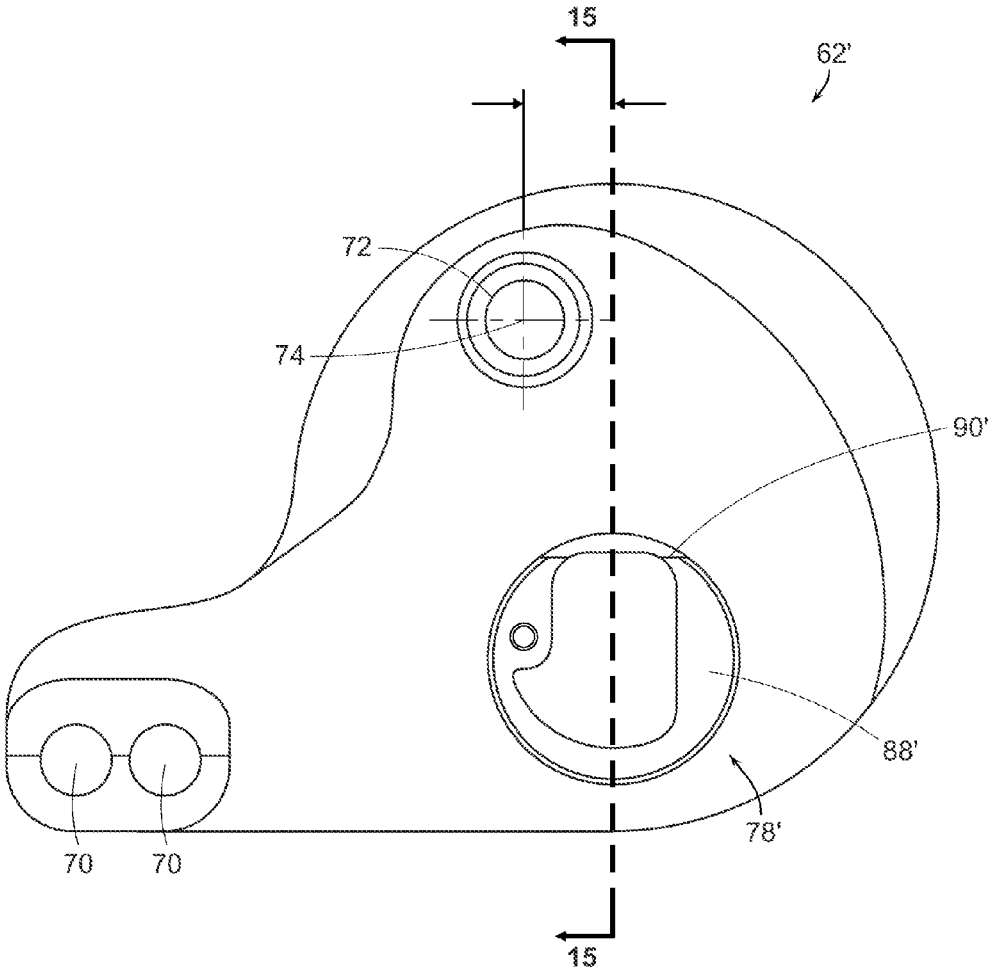
FIG. 14 is an elevational view of the connection member of FIG. 13.
Figure 15:
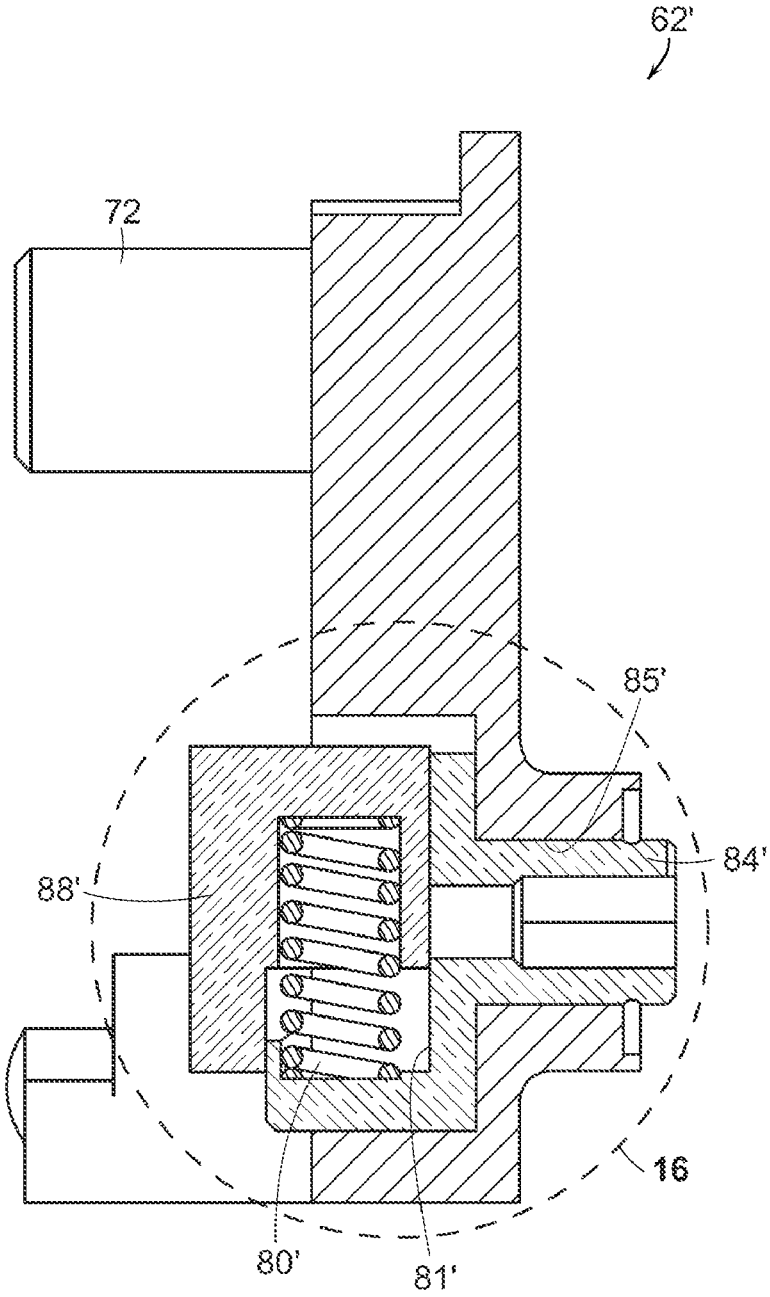
FIG. 15 is a cross-sectional view of the connection member of FIG. 13 taken along line 15-15 in FIG. 14.
Figure 16:
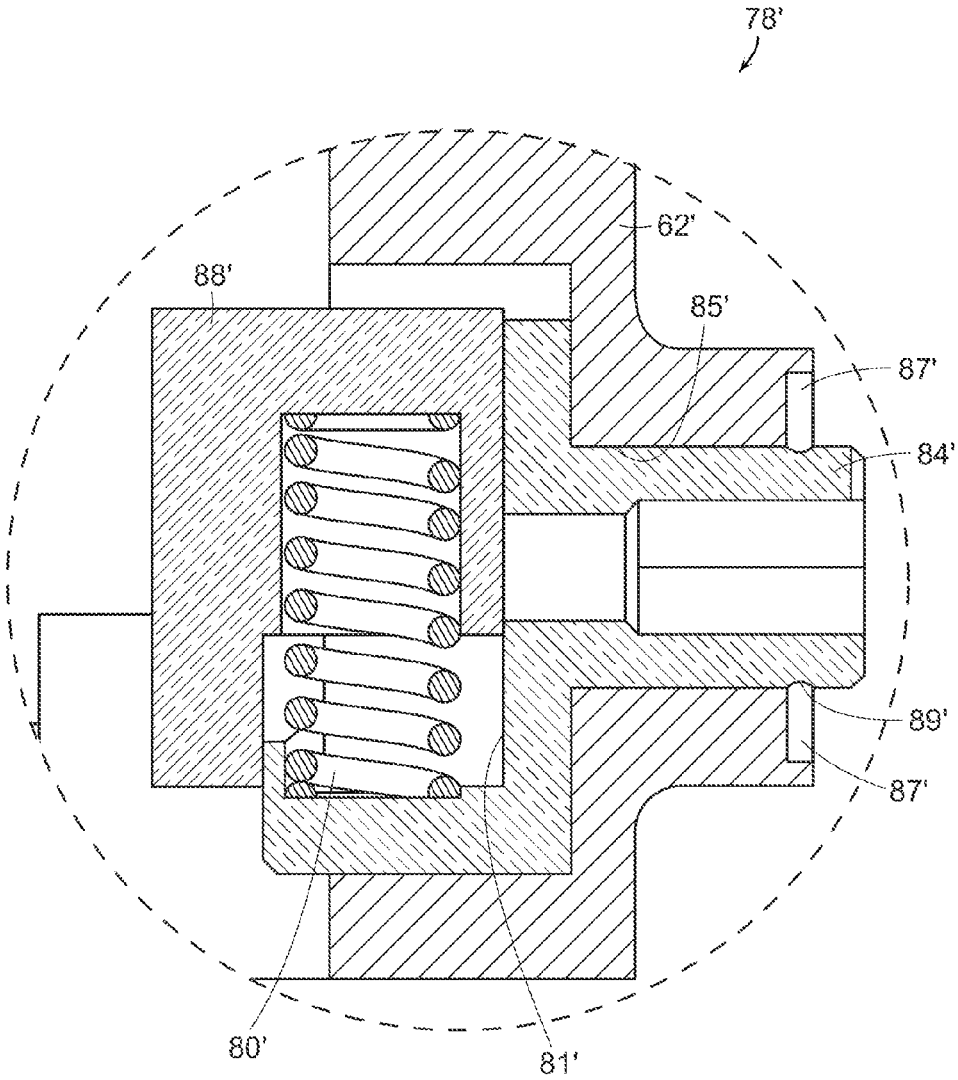
FIG. 16 is a detail view of a spring assembly of the connection member of FIG. 15 configured to bias the connection member into an engaged position.

Further to the above, referring to FIGS. 11 and 12, cam pin 84 can include an eccentric, or lobe, 88 extending therefrom which can be configured to abut surface 51 of base 52. In various embodiments, the biasing force applied to cam pin 84 by spring 80 as described above can bias lobe 88 into engagement with surface 51. More particularly, end 79 (FIG. 8) of drive pin 82 can fit within notch 85 of cam pin 84 such that spring 80 can cause cam pin 84 to rotate, or at least bias cam pin 84 to rotate, in a direction indicated by arrow 87. As a result of the above, lobe 88 can be rotated, or biased to rotate, upwardly such that, owing to contact between lobe 88 and surface 51, a downwardly-acting reaction force, $F_D$ (FIG. 10), can be transferred through cam pin 84 into connection member 62 causing connection member 62 to rotate in a direction indicated by arrow 89 and position projections 70 within recesses 68. Stated another way, referring to FIG. 10, lobe 88 can be offset from axis 74 by a distance "X1" such that the biasing force applied through lobe 88 can apply a moment, or torque, to connection member 62 thereby causing connection member 62 to rotate in a direction indicated by arrow 89 and move projections 70 upwardly into recesses 68. In various embodiments, this moment, or torque, can cause projections 70 to abut recesses 68.

In use, handles 76 can be lifted upwardly, i.e., in a direction opposite arrow 89, to rotate projections 70 downwardly and out of engagement with recesses 68. Such rotation of connection members 62 can move cam pin 84 upwardly toward surface 51 wherein lobe 88, as a result, can rotate downwardly in order to accommodate the upward movement of cam pin 84. Such rotation of lobe 88 can rotate cam pin 84 in a direction opposite of arrow 87 and, owing the interaction of end 79 of drive pin 82 and notch 85 of cam pin 84 as outlined above, cam pin 84 can displace drive pin 82 toward fastener 86 and compress spring 80. In various embodiments, spring 80 can be configured to store potential energy therein when it is compressed. In various alternative embodiments, although not illustrated, spring 80 can be stretched to store potential energy therein. In either event, connection members 62 can thereafter be released and, as a result of the potential energy stored within spring 80, spring 80 can move drive pin 82 toward cam pin 84, rotate cam pin 84 in a direction indicated by arrow 87, and rotate lobe 88 upwardly. Ultimately, as a result, the rotation of lobe 88 can rotate connection member 62 in a direction indicated by arrow 89 and projections 70 can be repositioned within recesses 68.

In various embodiments, cam lobe 88 can be configured to abut surface 51 regardless of the orientation of workholding device 50. More particularly, cam lobe 88 can be configured to remain in contact with surface 51 when axis 55 is positioned in either a horizontal direction or a vertical direction, for example. In either event, referring to FIG. 7, body portion 64 can include recess 65 which can be configured to receive at least a portion of connection member 62 therein and permit connection member 62 to rotate about pin 73 as described above. In at least one embodiment, recess 65 can include guide surface 63 against which a guide member of connection member 62, such as projection 61, for example, can abut, or slide thereagainst. In such embodiments, guide surface 63 can define a path for connection member 62 and/or support connection member 62 when a force is applied thereto. In various embodiments, although not illustrated, a workholding device can include a torsion spring having a first end engaged with body portion 64 and a second end engaged with connection member 62. In at least one such embodiment, when connection member 62 is rotated between first and second positions as described above, the torsion spring can be configured to resist the rotational movement of connection member 62 and store potential energy therein such that the torsion spring can bias connection member 62 back into its first, or engaged, position, for example.

In various alternative embodiments, a workholding device can include the biasing assembly depicted in FIGS. 13-16. In at least one embodiment, biasing assembly 78' can include spring 80', pin 84', and plunger 88'. When an operator lifts upwardly on handle 76 to disengage projections 70 from recesses 68 as outlined above, plunger 88' can be lifted upwardly toward surface 51. In at least one embodiment, plunger 88' can contact surface 51 and compress spring 80' within cavity 81'. Similar to the above, spring 80' can be configured to store potential energy therein which can, after handles 76 have been released by the operator, release the potential energy to move connection member 62' from its second, operably disengaged, position into its first, operably engaged, position. In various embodiments, plunger 88' can include a flat, or at least substantially flat, surface 90' which can be positioned flush against a flat, or at least substantially flat, portion of surface 51, for example. In such embodiments, pin 84' can be rotatably mounted within aperture 85' (FIG. 15) in connection member 62' such that, when connection member 62' is rotated as described above, pin 84' can rotate relative to connection member 62' and surface 90' can remain positioned flush against surface 51. In at least one embodiment, referring to FIG. 16, assembly 78' can further include retaining ring 87' which can be received within recess 89' in pin 84' such that translational movement between pin 84' and connection member 62' can be prevented, or at least inhibited.

Figure 4:
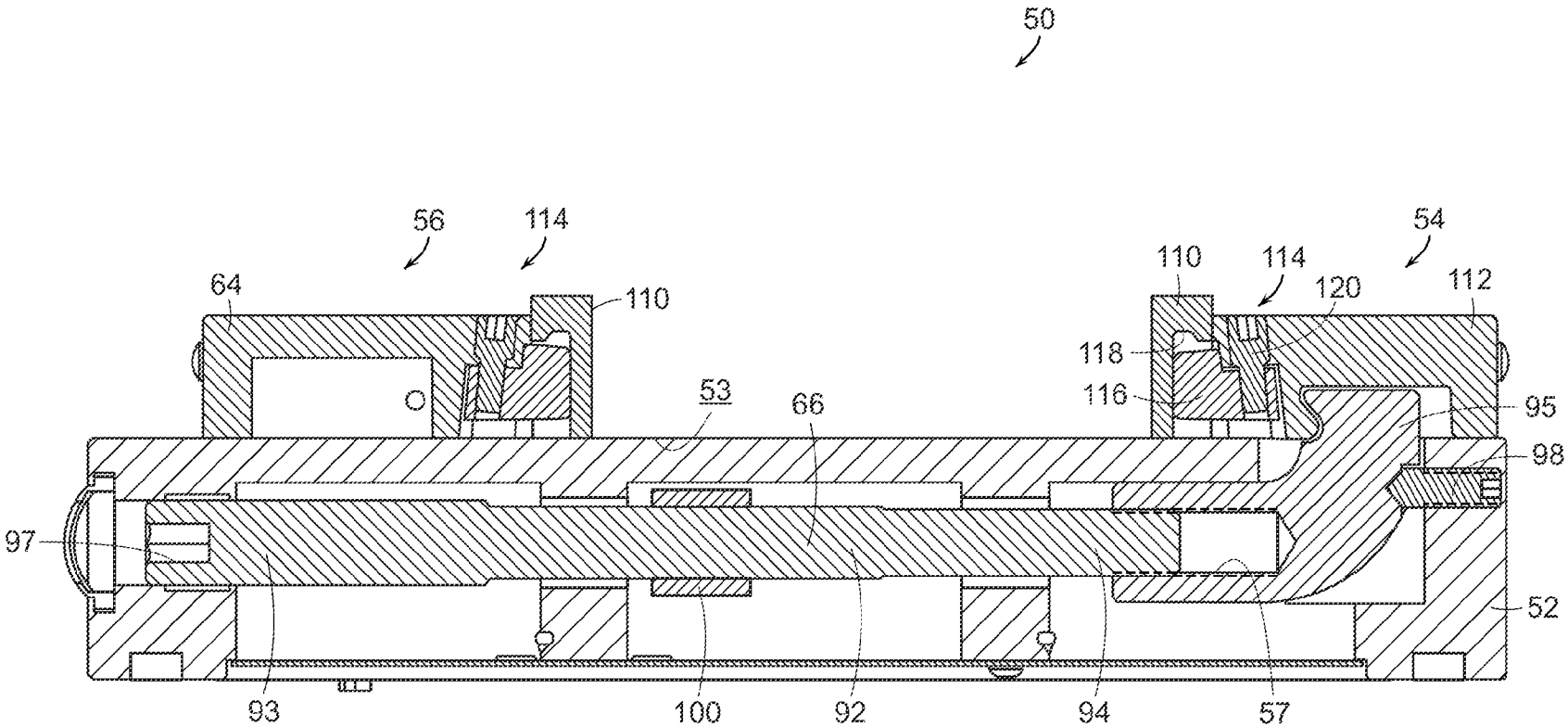
FIG. 4 is a cross-sectional view of the workholding device of FIG. 1 taken along line 4-4 in FIG. 3.

In order to move second jaw member 56 in small increments relative to base 52 and/or first jaw member 54 as outlined above, workholding device 50 can include a drive system configured to displace second jaw member 56 when jaw member 56 is engaged with at least one of racks 66. In at least one embodiment, referring to FIG. 4, the drive system can include drive member 92, wherein drive member 92 can include first end 93 and second end 94, and wherein second end 94 can be threadably engaged with at least one of base 52 and first jaw member 54, for example. In at least one such embodiment, base 52 and/or first jaw member 54 can include a threaded aperture 57 configured to threadably receive second end 94 such that, when drive member 92 is rotated about an axis, drive member 92 can be translated relative to base 52 and first jaw member 54. In various embodiments, the drive system can further include bushing, or crossbar, 100 mounted to drive member 92 wherein, when drive member 92 is rotated about its axis, crossbar 100 can be advanced toward and/or retracted away from first jaw member 54 along axis 55, depending on the direction, i.e., clockwise or counter-clockwise, in which drive member 92 is rotated. In at least one embodiment, racks 66 can be operably engaged with crossbar 100 such that, when crossbar 100 is translated relative to first jaw member 54 by drive member 92, racks 66 can be translated relative to first jaw member 54 by crossbar 100. In at least one such embodiment, although not illustrated, crossbar 100 can include projections extending therefrom which can be configured to fit within slots in racks 66 such that the drive force created by drive member 92 can be transferred into racks 66.

Further to the above, when second jaw member 56 is engaged with at least one of racks 66, second jaw member 56 can be translated relative to base 52, and first jaw member 54, when racks 66 are translated by drive member 92 as described above. In such embodiments, a workpiece can be positioned between jaw member 54 and 56 wherein, when large adjustments to the position of second jaw member 56 are necessary, second jaw member 56 can be released from racks 66 and brought into close opposition to, or contact with, the workpiece. Thereafter, second jaw member 56 can be re-engaged with racks 66 such that second jaw member 56 can be moved in small increments by drive member 92 until jaw member 56 is positioned firmly against the workpiece and a clamping force can be applied thereto. In various embodiments, first end 93 can be operatively engaged with a handle (not illustrated) such that drive member 92 can be easily turned as described above. In at least one such embodiment, referring to FIG. 4, first end 93 can include socket 97 which can be configured to receive the handle therein.

In various embodiments, as outlined above, drive member 92 can be operably connected to first jaw member 54 and second jaw member 56. In at least one such embodiment, the clamping force generated by drive member 92 can be directly transferred to a workpiece through jaw members 54 and 56 without having to flow through the base of the workholding device. More particularly, owing to the fact that first jaw member 54 can be threadably engaged with drive member 92 and second jaw member 56 can be releasably engaged with racks 66, the rotation of drive member 92 can generate a clamping force which is directly applied to the workpiece through jaw members 54 and 56. In various embodiments, referring to FIG. 4, the drive system can further include connection member 95 which can operably engage drive member 92 and first jaw member 54. In order to fix the position of first jaw member 54, jaw member 54 and base 52 can each include apertures therein configured to receive fasteners (not illustrated) which can secure jaw member 54 to base 52. In addition, device 50 can further include at least one set screw 98 which can be threadably retained in base 52 wherein set screw 98 can abut, or be positioned against, connection member 95, for example, to hold connection member 95 in position. In such embodiments, set screw 98 can prevent, or at least inhibit, unwanted movement or 'backlash' in connection member 95.

In various embodiments, the incremental travel of racks 66 and/or drive member 92 may be physically limited by shoulders and/or stops in base 52. In a further embodiment, although not illustrated, a detent mechanism, such as ball plunger, for example, may be used to provide an audio and/or tactile feedback to an operator indicating that racks 66 have reached the end of their desired or permitted stroke. In the event where the maximum stroke of racks 66 has been reached and further adjustment is still desired, connection members 62 may be released from racks 66 and then reengaged with an adjacent set of notches 68 such that the drive mechanism can be readjusted.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A workholding apparatus, comprising:

a base, comprising:

a support portion comprising a longitudinal axis, first longitudinal side, and a second longitudinal side;

a first longitudinal rack movably mounted to said support portion along said first longitudinal side;

a second longitudinal rack movably mounted to said support portion along said second longitudinal side; and a crossbar engaged with said first longitudinal rack and said second longitudinal rack;

a drive member operably engaged with said crossbar, wherein said drive member is configured to move said crossbar along said longitudinal axis;

a first jaw member; and a second jaw member slidably engaged with said base and supported by said support portion, wherein said crossbar is engaged with said second jaw member, said second jaw member comprising:

a first lateral claw movable between a disengaged position in which said first lateral claw is operatively disengaged from said first longitudinal rack and an engaged position in which said first lateral claw is engaged with said first longitudinal rack;

a second lateral claw movable between a disengaged position in which said second lateral claw is operatively disengaged from said second longitudinal rack and an engaged position in which said second lateral claw is engaged with said second longitudinal rack, wherein said drive member is configured to move said second jaw member relative to said first jaw member when at least one of said first lateral claw is engaged with said first longitudinal rack and said second lateral claw is engaged with said second longitudinal rack, and wherein said second jaw member is movable relative to said first jaw member and said drive member when said first lateral claw is in said second position disengaged from said first longitudinal rack and said second lateral claw is disengaged from said second longitudinal rack.

2. The workholding apparatus of claim 1, further comprising a first spring configured to bias said first lateral claw into engagement with said first longitudinal rack and a second spring configured to bias said second lateral claw into engagement with said second longitudinal rack.

3. The workholding apparatus of claim 1, further comprising a first biasing member configured to move said first lateral claw between its said disengaged position and said engaged position and a second member configured to move said first lateral claw between its said disengaged position and said engaged position.

4. The workholding apparatus of claim 1, wherein said second jaw member further includes a first pivot about which said first lateral claw can be rotated and a second pivot about which said second lateral claw can be rotated, and wherein said first pivot and said second pivot lie along a line.

5. The workholding apparatus of claim 4, wherein said first pivot defines a first pivot axis, wherein said second pivot defines a second pivot axis, wherein said drive member defines a displacement axis along which said second jaw is displaced, and wherein said displacement axis is not parallel to said first pivot axis and said second pivot axis.

6. The workholding apparatus of claim 4, wherein said second jaw member includes a housing, and wherein said first pivot includes a first pivot pin rotatably connecting said first lateral claw to said housing and said second pivot includes a second pivot pin rotatably connecting said second lateral claw to said housing.

7. The workholding apparatus of claim 1, wherein said first longitudinal rack includes a first plurality of recesses, wherein said second longitudinal rack includes a second plurality of recesses, wherein said first lateral claw includes a first projection configured to be received within at least one of said recesses and secure said second jaw member to said first longitudinal rack when said first lateral claw is in said engaged position, and wherein said second lateral claw includes a second projection configured to be received within at least one of said recesses and secure said second jaw member to said second longitudinal rack when said second lateral claw is in said engaged position.

8. The workholding apparatus of claim 7, wherein said first projection is not received within one of said recesses when said first lateral claw is in said disengaged position, and wherein said second projection is not received within one of said recesses when said second lateral claw is in said disengaged position.

9. The workholding apparatus of claim 1, wherein said support portion comprises a workpiece support surface, and wherein said first longitudinal rack and said second longitudinal rack are positioned below said workpiece support surface.

10. The workholding apparatus of claim 1, wherein said second jaw member further comprises:

a first lateral side;

a first lateral recess defined in said first lateral side, wherein at least a portion of said first lateral claw is positioned within said first lateral recess;

a second lateral side; and a second lateral recess defined in said second lateral side, wherein at least a portion of said second lateral claw is positioned within said second lateral recess.

11. The workholding apparatus of claim 2, wherein said first spring is positioned within said first lateral claw, and wherein said second spring is positioned within said second lateral claw.

12. A workholding apparatus, comprising:

a base comprising a workpiece support surface;

a first lateral member comprising a first bottom surface and a first array of engagement members defined in said first bottom surface;

a second lateral member comprising a second bottom surface and a second array of engagement members defined in said second bottom surface;

a drive member operably engaged with said first lateral member and said second lateral member, wherein said drive member is configured to move said first lateral member and said second lateral member simultaneously;

a first jaw member; and a second jaw member slidably engaged with said base, said second jaw comprising:

first selectively rotatable connection means for selectively disengaging said second jaw member from said first array of engagement members of said first lateral member; and second selectively rotatable connection means for selectively disengaging said second jaw member from said second array of engagement members of said second lateral member, wherein the concurrent disengagement of said first selectively rotatable connection means and the second selectively rotatable connection means is required to operably disengage said second jaw member from said driver member.

13. The workholding apparatus of claim 12, further comprising first biasing means for biasing said first selectively rotatable connection means into operative engagement with said first lateral member and second biasing means for biasing said second selectively rotatable connection means into operative engagement with said second lateral member.

14. A workholding apparatus, comprising:

a base, comprising:

a support portion comprising a longitudinal axis, first longitudinal side, and a second longitudinal side;

a first longitudinal rack movably mounted to said support portion along said first longitudinal side;

a second longitudinal rack movably mounted to said support portion along said second longitudinal side; and a crossbar engaged with said first longitudinal rack and said second longitudinal rack;

a drive member operably engaged with said crossbar, wherein said drive member is configured to move said crossbar along said longitudinal axis;

a first jaw member; and a second jaw member slidably engaged with said base and supported by said support portion, wherein said crossbar is engaged with said second jaw member, said second jaw member comprising:

a first lateral connector movable between a disengaged position in which said first lateral connector is operatively disengaged from said first longitudinal rack and an engaged position in which said first lateral connector is engaged with said first longitudinal rack;

a second lateral connector movable between a disengaged position in which said second lateral connector is operatively disengaged from said second longitudinal rack and an engaged position in which said second lateral connector is engaged with said second longitudinal rack, wherein said drive member is configured to move said second jaw member relative to said first jaw member when at least one of said first lateral connector is engaged with said first longitudinal rack and said second lateral connector is engaged with said second longitudinal rack, and wherein said second jaw member is movable relative to said first jaw member and said drive member when said first lateral connector is disengaged from said first longitudinal rack and said second lateral connector is disengaged from said second longitudinal rack.

15. The workholding apparatus of claim 14, further comprising a first spring configured to bias said first lateral connector into engagement with said first longitudinal rack and a second spring configured to bias said second lateral connector into engagement with said second longitudinal rack.

16. The workholding apparatus of claim 15, wherein said first spring is positioned within said first lateral claw, and wherein said second spring is positioned within said second lateral claw.

17. The workholding apparatus of claim 14, further comprising a first biasing member configured to move said first lateral connector between its said disengaged position and said engaged position and a second member configured to move said first lateral connector between its said disengaged position and said engaged position.

18. The workholding apparatus of claim 14, wherein said second jaw member further includes a first pivot about which said first lateral connector can be rotated and a second pivot about which said second lateral connector can be rotated, and wherein said first pivot and said second pivot lie along a line.

19. The workholding apparatus of claim 18, wherein said first pivot defines a first pivot axis, wherein said second pivot defines a second pivot axis, wherein said drive member defines a displacement axis along which said second jaw is displaced, and wherein said displacement axis is not parallel to said first pivot axis and said second pivot axis.

20. The workholding apparatus of claim 18, wherein said second jaw member includes a housing, and wherein said first pivot includes a first pivot pin rotatably connecting said first lateral connector to said housing and said second pivot includes a second pivot pin rotatably connecting said second lateral connector to said housing.

21. The workholding apparatus of claim 14, wherein said first longitudinal rack includes a first plurality of recesses, wherein said second longitudinal rack includes a second plurality of recesses, wherein said first lateral connector includes a first projection configured to be received within at least one of said recesses and secure said second jaw member to said first longitudinal rack when said first lateral connector is in said engaged position, and wherein said second lateral connector includes a second projection configured to be received within at least one of said recesses and secure said second jaw member to said second longitudinal rack when said second lateral connector is in said engaged position.

22. The workholding apparatus of claim 21, wherein said first projection is not received within one of said recesses when said first lateral connector is in said disengaged position, and wherein said second projection is not received within one of said recesses when said second lateral connector is in said disengaged position.

23. The workholding apparatus of claim 14, wherein said support portion comprises a workpiece support surface, and wherein said first longitudinal rack and said second longitudinal rack are positioned below said workpiece support surface.

24. The workholding apparatus of claim 14, wherein said second jaw member further comprises:

a first lateral side;

a first lateral recess defined in said first lateral side, wherein at least a portion of said first lateral connector is positioned within said first lateral recess;

a second lateral side; and a second lateral recess defined in said second lateral side, wherein at least a portion of said second lateral connector is positioned within said second lateral recess.

* * * * *